US005244444A

United States Patent [19]

Wostry

[11] Patent Number: 5,244,444

[45] Date of Patent: Sep. 14, 1993

[54] EXERCISER

[76] Inventor: Frank Wostry, 27 Broadway La., Fairfield, N.J. 07004

[21] Appl. No.: 954,018

[22] Filed: Sep. 30, 1992

[51] Int. Cl.[5] ..... A63B 21/08

[52] U.S. Cl. ..... 482/97; 482/117; 482/109

[58] Field of Search ..... 482/114, 118, 93, 97, 482/109, 110, 106, 108, 117

[56] References Cited

U.S. PATENT DOCUMENTS

| | | | |
|---|---|---|---|
| 605,747 | 6/1898 | Sachs et al. | 482/97 |
| 1,366,200 | 1/1921 | Matysek . | |
| 2,356,260 | 8/1944 | Maxwell | 482/97 |
| 2,921,791 | 1/1960 | Berne | 482/118 |
| 3,428,311 | 2/1969 | Mitchell . | |
| 4,103,887 | 8/1978 | Shofler . | |
| 4,249,727 | 2/1981 | Dehan . | |
| 4,603,856 | 8/1986 | Fiore | 482/114 |
| 4,634,121 | 1/1987 | Sasaki | 482/109 |

*Primary Examiner*—Stephen R. Crow

[57] ABSTRACT

An exercising device includes an adjustable weighted handle at the end of an elongated telescoping tube of an adjustable height. The tube is connected to a rotatable joint mounted on a base. The device can be rotated about a 360° arc and also up and down through about 180° in a vertical plane. The preferred movement is to swing the handle back and forth in a circular path and twist the body around from side to side and up and down. Deep breathing is synchronized with the movement to provide exercise to the entire body, lungs and circulatory system. The adjustable weighted handle and height and rotary movement can accommodate a variety of individual requirements. The components can be readily disassembled to provide portability.

11 Claims, 4 Drawing Sheets

FIG. 8
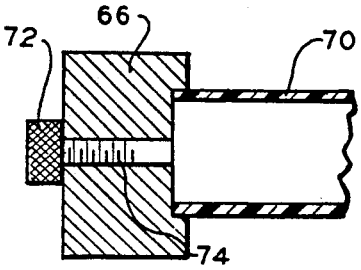
FIG. 6
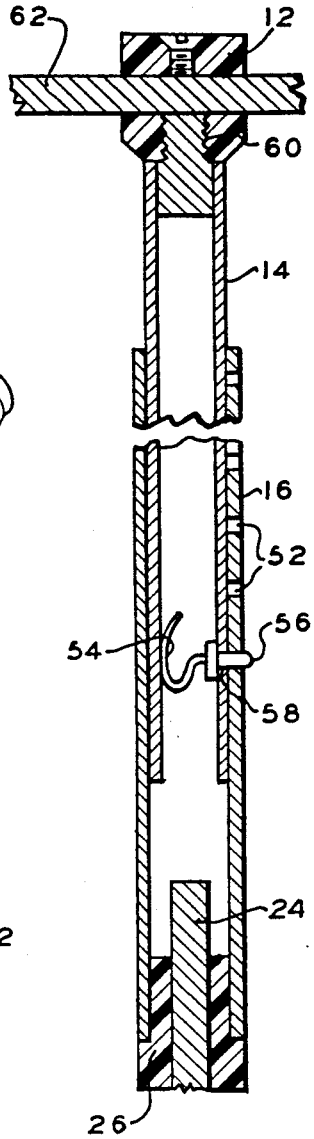
FIG. 3
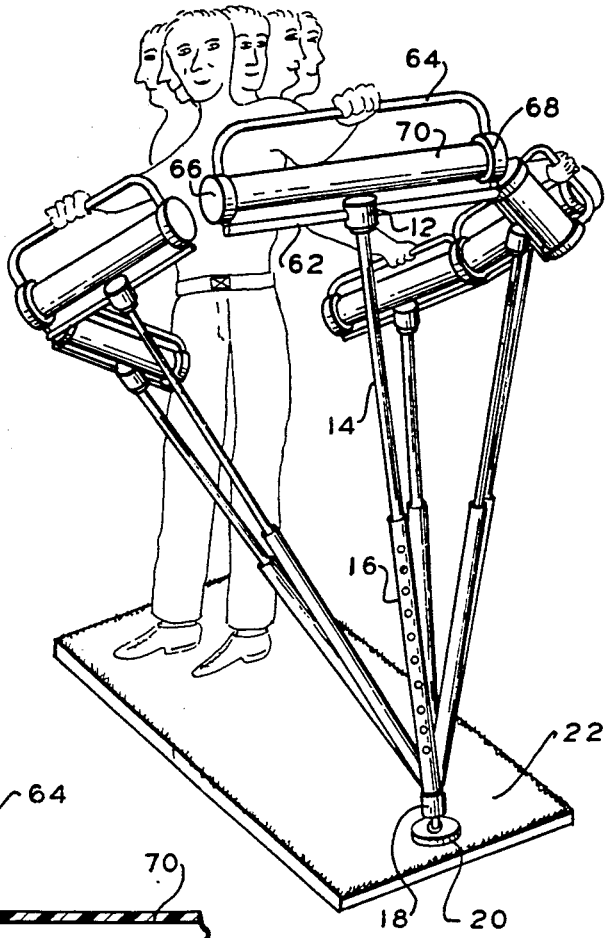
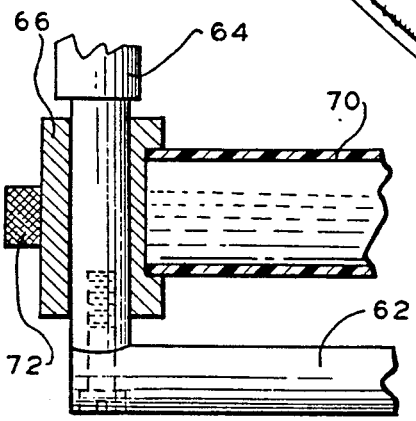
FIG. 7

FIG. 9
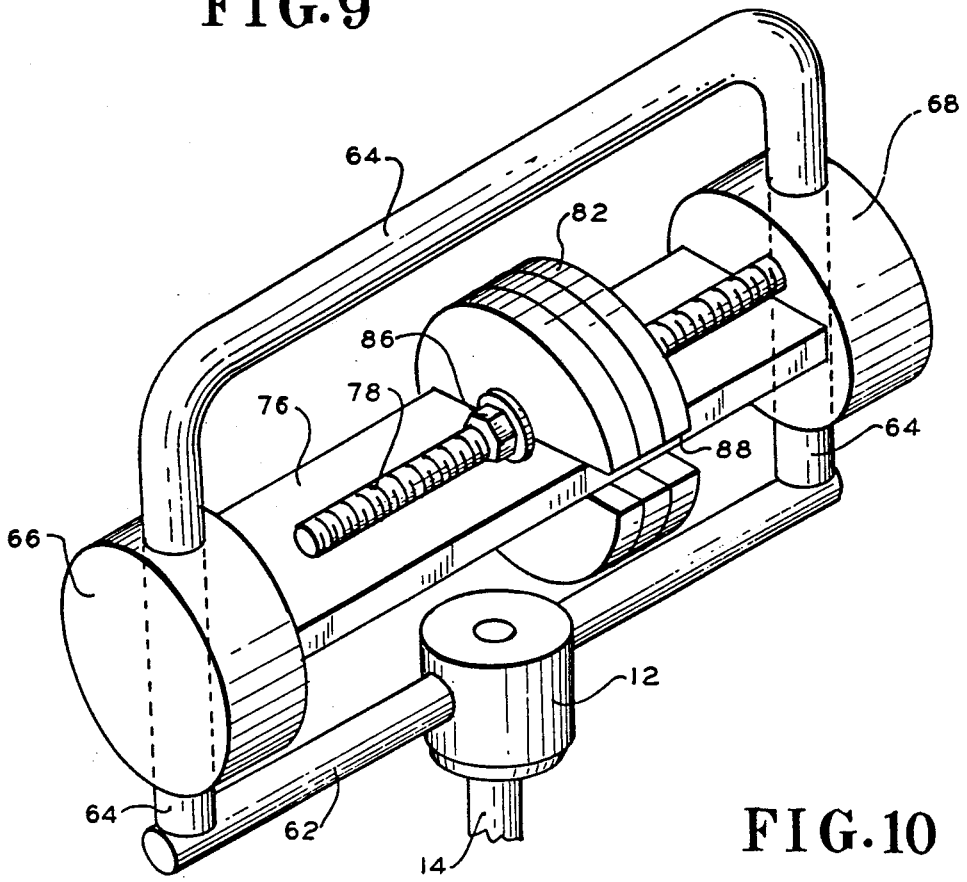
FIG. 10
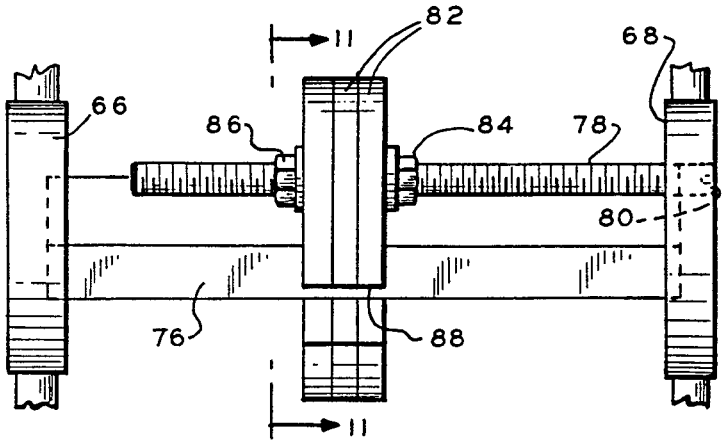
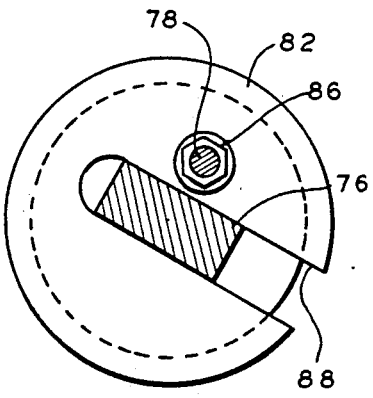
FIG. 11

EXERCISER

BACKGROUND OF THE INVENTION

1. Field of the Invention

The present invention relates to exercising devices and particularly to an apparatus which the individual moves manually in a variety of rotary motions to exercise the entire body.

2. Description of the Prior Art

Presently known exercising devices are generally complex apparatus including resistance mechanisms such as springs which require muscular exertion to achieve the desired effects. Other devices utilize weights which must be lifted with strenuous effort. The devices also are generally concerned with exercising particular portions of the body such as arms, legs and specific muscle groups. An example of such a device is shown in U.S. Pat. No. 3,428,111 which includes an elongated rod having a handle at the upper end and a rotatable ball in a concave seat at the lower base end that is secured on a fixed surface. A cage fitting around the lower end of the ball and threaded into the seat permits an adjustable frictional engagement providing a variable resistance to movement of the device. The handle and rod are movable in arcs within limits of the seat opening, and the ball can be tilted and rotated to provide a twisting and rocking exercise for the wrists and arms.

Another similar device is shown in U.S. Pat. No. 4,249,727 which also includes a longitudinal bar connected to a rotatable ball within a concave supporting base to permit rotary movement. An adjustable wedge applies a desired friction to the ball to vary the muscular effort of the person using the exerciser. A telescoping tubular structure for the bar permits adjustment of the length. The primary purpose of the device is to exercise back and abdominal muscles.

Other devices are directed to the use of adjustable weights that have hollow centers that can be filled or emptied to increase or decrease the weight that must be lifted. One such exerciser is shown in U.S. Pat. No. 1,366,200. The weights are positioned along a bar and have apertures to permit addition or removal of the contents to vary the weight. Nuts fit into the apertures to retain the contents. Another like apparatus is shown in U.S. Pat. No. 4,103,887 wherein collapsible enclosures at the ends of a supporting bar can be filled with water or sand to permit use as a barbell. The enclosures are made of a flexible plastic having apertures and resilient closure means to prevent leakage. The enclosures are collapsed to provide portability. These devices, however, have relatively limited use for exercising particular areas of the body.

SUMMARY OF THE INVENTION

It is, therefore, the primary object of the present invention to provide a simple exercising device which is manually operable to exercise the entire body.

It is another object of the invention to provide a device which can be moved in a rotary motion in an unlimited manner to meet a variety of individual needs.

A further object of the invention is to provide a rotatable exerciser having a variable height and adjustable weights to suit different abilities.

An additional object of the invention is to provide an exerciser which has universal application, is inexpensive, efficient and readily transportable;

A still further object of the invention is to provide an exerciser which relies on the individual user to choose the degree of effort required and which may be beneficial in weight reduction, muscular development and improvements in lung and circulatory functions.

These objects are achieved with a unique structure which provides an elongated rod and handle that are rotatable about a substantially 360° arc, with the weight at the upper handle end being adjustable for individual users. The elongated rod includes two telescoping tubes to permit adjustment of the height. A rotatable joint secured to a base and support medium such as a carpet section may be formed of a resilient flexible material such as a solid rubber tube, or a ball joint that permits rotation about a 360° arc. The weighted handle may include a hollow cylinder that can be filled with a variable volume of water, or a cross member receiving a number of fixed weights to permit adjustment of the total weight a desired. Other objects and advantages will become apparent from the following description in conjunction with the accompanying drawings.

BRIEF DESCRIPTION OF THE DRAWINGS

FIG. 3 is an illustrative view showing the exerciser in use in a number of different rotatable positions;

FIG. 6 is a cross sectional view of a portion of the telescoping tubular rod with the adjustable height mechanism and handle joint;

FIGS. 7 and 8 are cross sectional views of a end portion of a weighted handle filled with water;

FIG. 9 is a perspective view of a weighted handle having a plurality of removable weights;

FIG. 10 is a front view of the weighted handle of FIG. 9; and

FIG. 11 is a partial sectional end view thereof.

DESCRIPTION OF THE PREFERRED EMBODIMENTS

Figure 1:
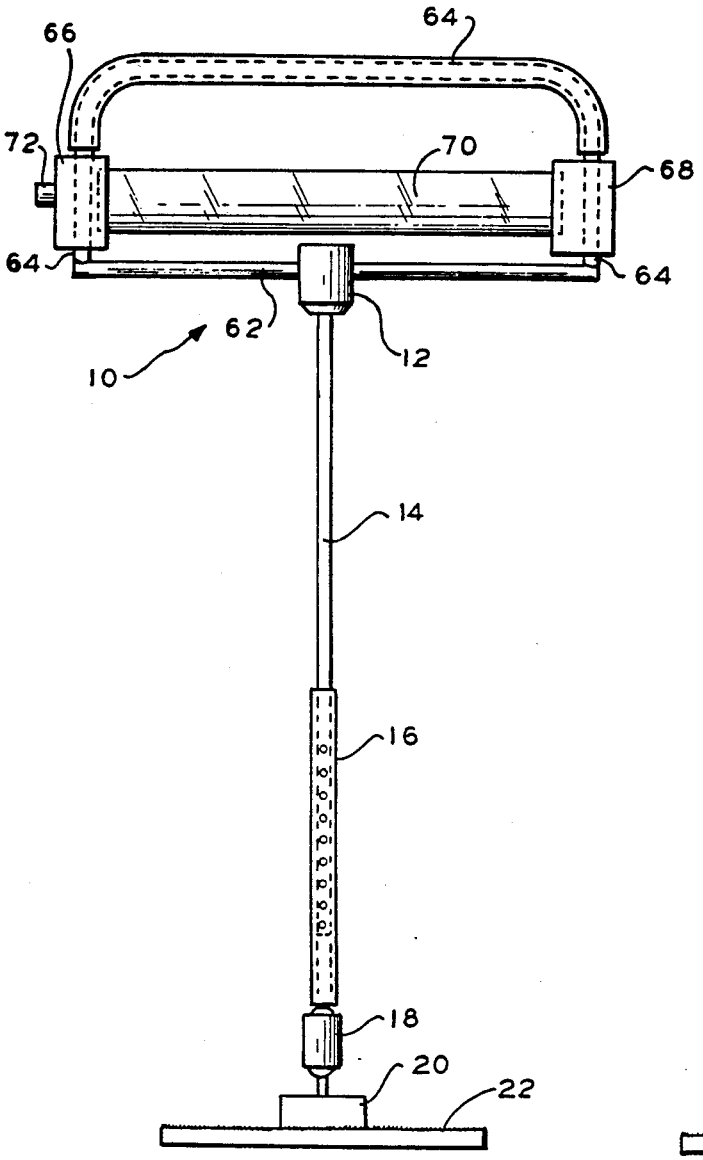
FIG. 1 is a front view of the exerciser in an upright position showing the handle, telescoping tubular rod and rotatable joint secured to a base.
Figure 2:
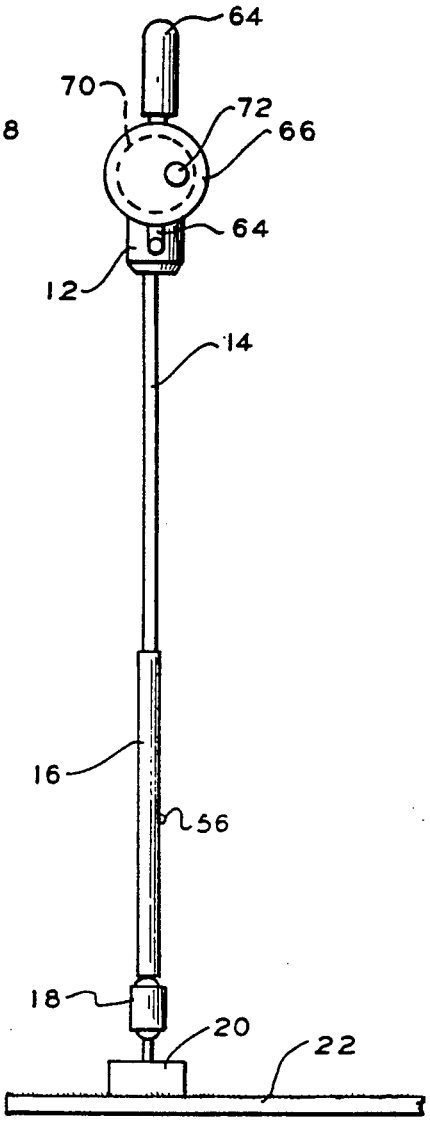
FIG. 2 is a side view of the exerciser.

As shown in FIGS. 1 and 2, the exerciser includes a weighted handle 10 secured by a fixed joint 12 to the upper portion of a thin hollow telescoping tubular metal bar or rod 14 which fits closely into a like wider lower tubular rod portion 16. The tubular rod 16 is connected to a rotatable joint 18 secured to a rigid plastic base support 20 mounted on a transportable section of carpet 22.

Figure 4:
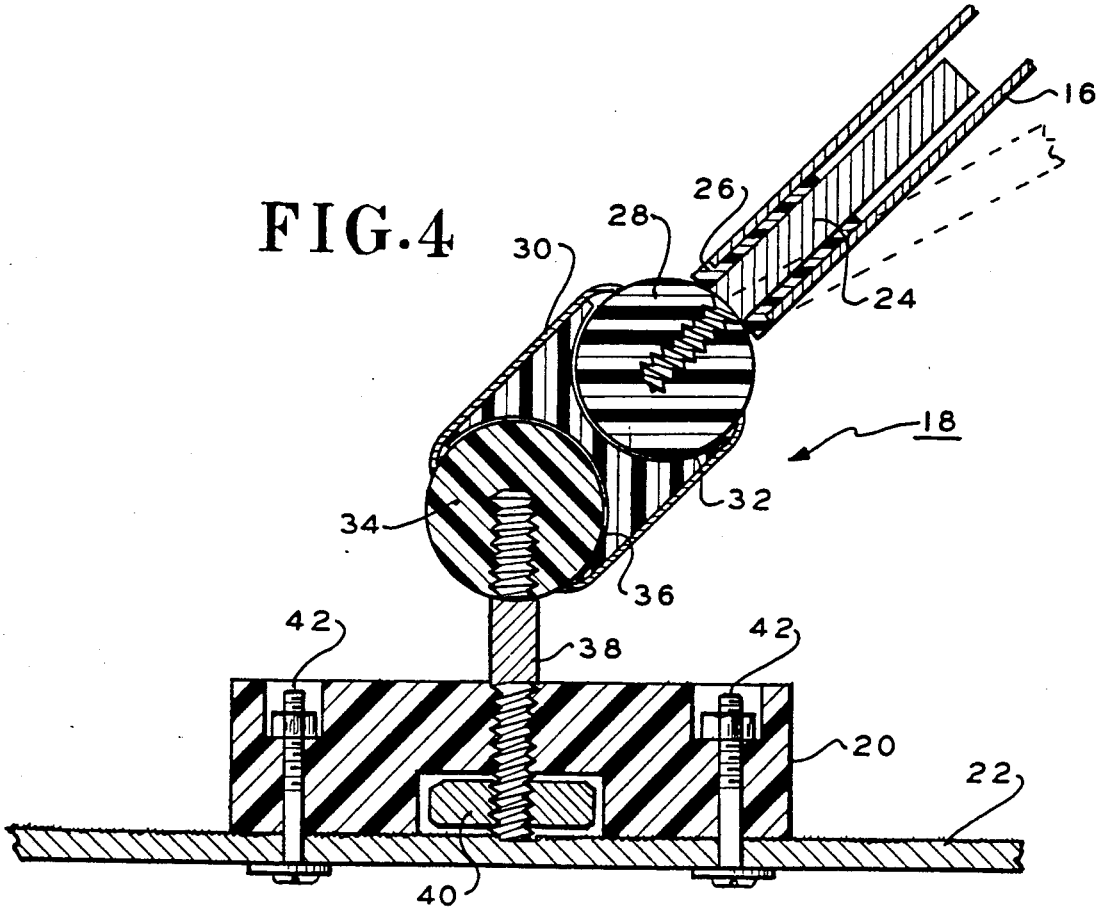
FIG. 4 is a cross sectional view of one embodiment of the rotatable joint and base.

As shown in FIG. 4, the rotatable joint includes a metal insert 24 which slidably fits into a nylon bushing 26 secured in the end of tubular rod 16. Insert 24 includes a threaded end secured to a rotatable nylon ball 28. Ball 28 fits into a metal cylinder 30 enclosing a nylon insert having a socket 32. A second rotatable nylon ball 34 fits into the other end of cylinder 30 and nylon insert having a second socket 36. A metal post 38 has a threaded end secured to ball 34 and the other threaded end secured by nut 40 to a nylon base 20. Base 20 is mounted on a section of carpet 22 by four bolts and nuts 42. Cylinder 30 overlaps the balls 28, 34 to secure them within the sockets. The two rotatable balls 28, 34 permit tubes 16, 14 and the connected handle to be rotated about a 360° circle as well as swing close to 180° in a vertical plane. The tube 16 and entire upper portion and handle can be removed from insert 24 of the rotatable joint to facilitate transportability. The base and carpet section can be moved separately.

Figure 5:
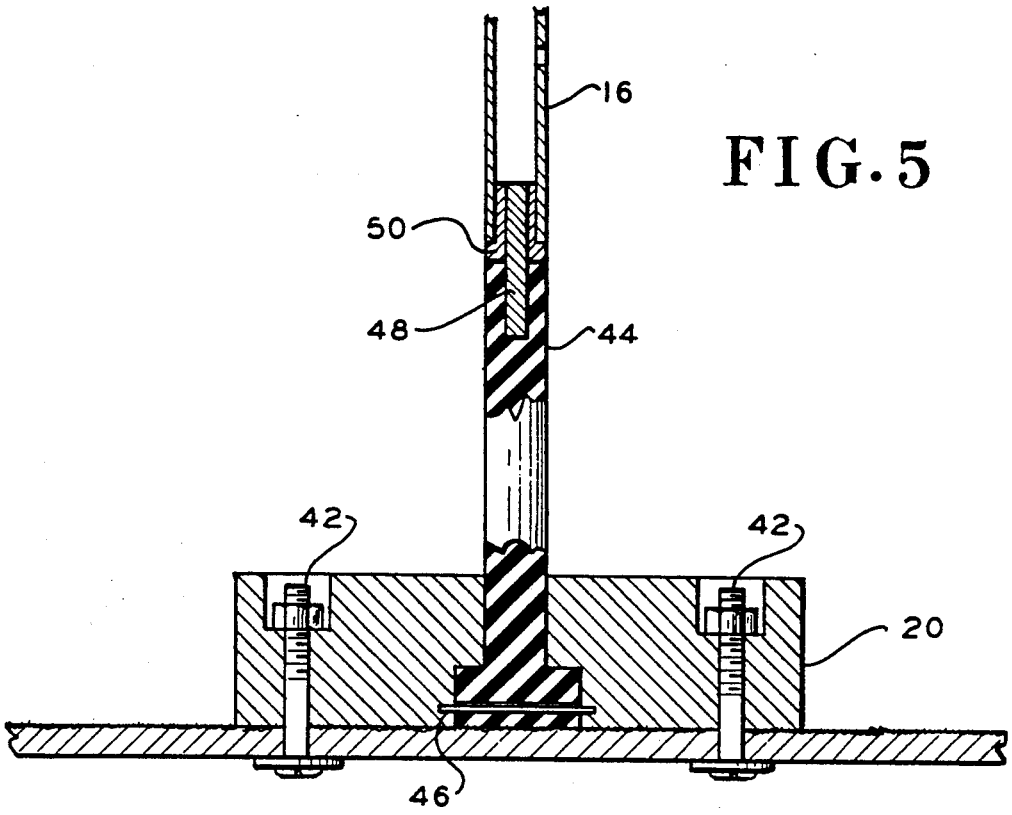
FIG. 5 is a cross sectional view of the second type of rotatable joint and base.

FIG. 5 shows an alternate rotatable joint formed of a solid flexible rubber rod 44 secured to base 20 by a spring clip 46. A metal insert 48 at the upper end of rubber rod 44 adheres to the rubber and slidably fits into a nylon bushing 50 within tubular rod 16. The rubber is sufficiently strong and flexible to permit tube 16 and the entire exercise to be rotatable about a 360° circle and through substantially a 180° vertical arc.

As shown in FIG. 6, the lower tubular rod 16 includes a plurality of spaced holes 52 aligned along a vertically extending segment. The upper tubular rod 14 includes an inner spring member 54 secured at the lower end and having a projecting pin 56 which fits through a corresponding hole 58 in tube 14 and into holes 52 in tube 16. By pressing pin 56 in and sliding tube 14 into tube 16 to a desired vertical position which permits pin 56 to extend through a selected hole 52, the height of the telescoping tubes is adjusted.

The upper end of tubular rod 14 includes a threaded metal insert 60 which is secured to a nylon member 12 forming a joint with a horizontal metal tube 62, as shown in FIG. 1. Opposite vertical extensions of handle bar 64 pass through end support members 66 and 68 and are suitably secured to the ends of tube 62.

In one embodiment shown in FIG. 1, handle 10 includes a hollow cylinder 70 supported between end members 66, 68. FIGS. 7 and 8 show one end of cylinder 70 which may contain water or other suitable medium as a weight. A threaded bolt 72 fits through a hole 74 in end member 66 to provide an opening for supplying water to cylinder 70. The amount of water inserted into the cylinder determines the weight of the handle which is thus adjustable.

Another embodiment of a weighted handle is shown in FIGS. 9, 10 and 11 wherein a rectangular plastic bar 76 is supported between end members 66, 68. An elongated threaded shaft 78 held in end 68 by a set screw 80 positions a plurality of removable weights 82 on bar 76. A pair of flanged nuts 84, 86 secure the weights in place. The weights have notches 88 to facilitate sliding onto and removal from bar 76. The number of weights may be selected to meet individual requirements.

The preferred method for utilizing the exerciser is illustrated in FIG. 3 wherein the person is shown swinging the exerciser in a rotary motion about rotatable joint 18. Since the weighted handle and tubular support are rotatable through a substantially 360° circle as well as a 180° arc in a vertical plane, unlimited variations may be obtained to exercise various parts of the body. The height is first adjusted so that the handle is a little above the shoulder level of the individual and a desired weight is applied to the handle. The person may stand sideways as shown with feet apart with one hand on the handle at a distance of a few feet. The exerciser is lifted up from the floor and then swung in a rotary motion back and forth to twist the body exhalation of the lungs must be synchronized with the rotary movement to achieve maximum benefits.

Thus, with one hand gripping the handle, as shown, the person first swings clockwise from left to right and inhales deeply and then swings back to the left in a deep bending and sweeping motion while strongly exhaling. On the swing back to the right, a deep inhalation is made. This motion is repeated for a desired length of time and number of movements to exercise various parts of the body such as arms, legs, chest and back. The position of the person may then be changed to face in the opposite direction and swing the weighted handle first from right to left and back while deeply inhaling and exhaling. Other positions can include facing the exerciser while swinging equally to the left and right and holding the handle with both hands.

The device thus provides a simple sturdy structure having a range of motion and effort that is infinitely variable. The natural movement of the body in swinging the device alternately stretches and relaxes the blood vessels, tissues and muscles and gently pivots the joints in a stimulating therapeutic manner.

While only a limited number of embodiments have been illustrated and described, many other variations may be made in the particular configuration without departing from the scope of the invention as set forth in the appended claims.

What is claimed is:

1. An exercising device comprising:

a base;

a rotatable joint secured on said base;

a longitudinal tubular rod having a lower end coupled to said joint and rotatable therewith, said tubular rod including upper and lower telescoping sections extending upwardly from said base and providing an adjustable height for said rod above said base, means for securing said telescoping sections at a selected height;

a laterally extending handle member secured across the upper end of said tubular rod; and adjustable weight means secured to and extending laterally along said handle, the total weight on said handle being adjustable.

2. The device of claim 1 wherein said handle member includes a lower lateral tubular member secured to the upper end of said tubular rod, an upper lateral tubular member, a pair of end members securing the opposite ends of said lower and upper lateral tubular members, said adjustable weight means being secured to and extending between said end members.

3. The device of claim 2 wherein said upper and lower telescoping rod sections are hollow, said rotatable joint including a longitudinal insert extending therefrom and slidable into the lower end of said lower rod section for removably coupling said joint and tubular rod.

4. The device of claim 3 wherein said rotatable joint is rotatable in a 360° circle in one dimension and substantially a 180° arc in a second dimension.

5. The device of claim 4 wherein said rotatable joint includes a post extending from said base, a first ball coupled to said post, a socket member having a lower socket receiving and securing said first ball and being rotatable about said first ball, said socket member including an upper socket, a second ball received and secured within said upper socket and rotatable therein, said second ball being secured to said longitudinal insert extending into said lower rod to permit rotation of said longitudinal rod.

6. The device of claim 4 wherein said rotatable joint includes a resilient flexible post extending from said base, said longitudinal insert being secured within the upper end of said resilient flexible post and extending into said lower rod to permit rotation therewith.

7. The device of claim 4 wherein said adjustable weight means includes a support bar extending between said handle end members, a plurality of selectable weights slidable onto said support bar, and means for securing said weights on said bar.

8. The device of claim 4 wherein said adjustable weight means includes a hollow cylinder extending between said handle end members, an opening for supplying a selected volume of fluid to said cylinder, and means for closing said opening for retaining said fluid in said cylinder.

9. The device of claim 4 wherein said lower telescoping rod includes a plurality of spaced holes aligned along a longitudinal segment, a spring member secured at one end within the lower end of said upper telescoping member and having a pin projecting from the other end, a hole in said upper telescoping rod for receiving said pin, said pin being extendable through a selected hole in said lower telescoping rod to permit adjustment of the height of said rod sections.

10. The device of claim 9 wherein said base includes means for supporting said rotatable joint and securing said joint thereto.

11. The device of claim 10 wherein said base is a rigid plastic material and includes a section of a thin flexible floor covering material secured to the bottom of said base for positioning said device on a flat surface.

* * * * *